US010190333B2

(12) United States Patent
Corwin, Jr. et al.

(10) Patent No.: US 10,190,333 B2
(45) Date of Patent: Jan. 29, 2019

(54) RESILIENTLY MOUNTED STRIKE PLATE OF AN ELECTROMAGNETIC DOOR LOCK

(71) Applicant: Hanchett Entry Systems, Inc., Phoenix, AZ (US)

(72) Inventors: Larry Gene Corwin, Jr., Mesa, AZ (US); Dan Van Dusen, Mesa, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

(21) Appl. No.: 15/486,431

(22) Filed: Apr. 13, 2017

(65) Prior Publication Data

US 2017/0298653 A1 Oct. 19, 2017

Related U.S. Application Data

(60) Provisional application No. 62/322,344, filed on Apr. 14, 2016, provisional application No. 62/381,387, filed on Aug. 30, 2016.

(51) Int. Cl.

| | |
|---|---|
| ***E05C 17/56*** | (2006.01) |
| ***E05C 19/16*** | (2006.01) |
| ***E05B 15/02*** | (2006.01) |
| ***E05B 17/20*** | (2006.01) |
| ***E05B 47/00*** | (2006.01) |

(Continued)

(52) U.S. Cl.

CPC ..... *E05B 15/022* (2013.01); *E05B 17/2084* (2013.01); *E05B 47/0002* (2013.01); *E05C 19/166* (2013.01); *E05B 63/0056* (2013.01); *E05B 2015/0465* (2013.01); *E05B 2047/0065* (2013.01); *E05B 2047/0068* (2013.01)

(58) Field of Classification Search

CPC ..... E05B 15/022; E05B 17/2084; E05B 47/0002; E05B 19/166; E05B 63/0056; E05B 2015/0065; E05B 2047/0065; E05B 2047/0068; Y10T 292/11

USPC ..... 292/251.5

See application file for complete search history.

(56) References Cited

U.S. PATENT DOCUMENTS 2,530,628 A * 11/1950 Pivero ..... E05B 77/54 292/144

2,693,382 A * 11/1954 Teetor ..... E05C 19/16 292/251.5

(Continued)

*Primary Examiner* — Kristina R Fulton

*Assistant Examiner* — Faria F Ahmad

(74) *Attorney, Agent, or Firm* — Woods Oviatt Gilman LLP; Ronald J. Kisicki, Esq.

(57) ABSTRACT

A strike plate mounting bolt assembly for resiliently mounting a strike plate to a door. The strike plate mounting bolt assembly includes a bolt and a post wherein the bolt is securably engageable with the post. The bolt is inserted through a bore in the door and the post is inserted through a bore in the strike plate. A resilient member such as at least one Belleville washer is disposed between a head of the post and a cavity in the strike plate wherein the at least one Belleville washer is compressed between the post head and cavity upon securing the bolt and post together to provide a resilient mount between the door and strike plate. The at least one Belleville washer may be a number of Belleville washers selectable stacked to form a pack of Belleville washers. By varying the number and orientation of the Belleville washers, the force/deflection characteristics of the pack may be tuned to accommodate the needs of a variety of electromagnetic lock design features.

9 Claims, 5 Drawing Sheets

(51) Int. Cl.
*E05B 63/00* (2006.01)
*E05B 15/04* (2006.01)

(56) References Cited

U.S. PATENT DOCUMENTS

| | | | | | |
|---|---|---|---|---|---|
| 2,727,772 | A * | 12/1955 | Hamilton | E05C 19/168 | 109/63.5 |
| 3,060,786 | A * | 10/1962 | Flower | F16B 5/0208 | 292/251.5 |
| 4,915,431 | A * | 4/1990 | Bailey | E05C 19/166 | 292/251.5 |
| 5,065,136 | A * | 11/1991 | Frolov | E05B 65/108 | 292/251.5 |
| 5,758,913 | A * | 6/1998 | Roth | E05B 65/108 | 292/251.5 |
| 6,053,546 | A * | 4/2000 | Frolov | E05C 19/166 | 292/144 |
| 6,135,515 | A * | 10/2000 | Roth | E05C 19/166 | 292/251.5 |
| 6,609,738 | B1 * | 8/2003 | Roth | E05B 65/108 | 292/144 |
| 8,094,017 | B2 | 1/2012 | Hunt et al. | | |
| 8,757,685 | B2 * | 6/2014 | Chang | E05C 17/56 | 292/251.5 |
| 8,820,803 | B2 * | 9/2014 | Hunt | E05B 65/108 | 292/251.5 |
| 8,864,188 | B2 * | 10/2014 | Redgrave | E05C 19/16 | 292/251.5 |
| 9,062,481 | B2 * | 6/2015 | Liao | E05C 19/166 | |
| 9,151,099 | B2 * | 10/2015 | Allison | E05F 1/105 | |
| 2013/0127260 | A1 | 5/2013 | Webb et al. | | |

* cited by examiner

RESILIENTLY MOUNTED STRIKE PLATE OF AN ELECTROMAGNETIC DOOR LOCK

RELATIONSHIP TO OTHER APPLICATIONS AND PATENTS

The present application claims the benefit of U.S. Provisional Patent Application No. 62/322,344, filed Apr. 14, 2016, and U.S. Provisional Patent Application No. 62/381,387, filed Aug. 30, 2016, which are hereby incorporated by reference in their entirety.

TECHNICAL FIELD

The present invention relates to electromagnetic door locks for securing a door to a door frame in a closed position; particularly to an electromagnetic door lock having a strike plate and an associated electromagnet wherein the strike plate is held in contact with the electromagnet when the electromagnet is energized; and more particularly, wherein said strike plate is resiliently mounted to the door so that a controlled amount of door movement in the opening direction is permitted while the strike plate remains in contact with the energized electromagnet.

BACKGROUND OF THE INVENTION

Electromagnetic door locks are widely used in diverse electronic door applications. These locks typically use electromagnets attached to the door frame in conjunction with a ferromagnetic strike plate attached to the door, to hold the door firmly closed.

In many current designs, means are provided in the electromagnetic door lock to permit a controlled amount of door movement in the opening direction while the armature or strike plate of the lock remains in contact with an energized electromagnet, to improve the ability of a door equipped with a magnetic lock to withstand a physical blow. A coil spring disposed with the door allows for some relative movement between the door and strike plate. This design feature of the electromagnetic strike is referred to herein as an "Energy Absorbing" design feature. The means provides linear elasticity to the door by absorbing some of the kinetic energy of the blow upon compression of the spring, thus lowering the peak force experienced to separate the strike plate from the electromagnet during a physical attack against the door and allowing for a lower powered electromagnet to be used.

In current electromagnetic door lock designs, there may also exist a means that momentarily delays de-energizing of the electromagnet after a force to open the door is applied. This design feature is often associated with exit doors in commercial buildings or restaurants that permit emergency egress through doors normally locked. In a delayed magnetic lock (:"De-Mag" design feature), if an opening force is applied to a locked door continuously through a first predetermined period of time (the "delay period"), the electromagnet will be de-energized, allowing the door to be opened. If the opening force applied to the door is terminated within a second predetermined period of time (the "nuisance delay period") wherein the second predetermined period of time is less than the first predetermined period of time, the electromagnet will remain energized and the door will remain locked. Typically, an audible signal will be sounded during the first predetermined period of time providing an alarm that an attempt is being made to exit through the locked door.

In current electromagnetic door lock designs, there may also exist a power savings design feature (Eco-Mag design feature). By the Eco-Mag design feature, the electromagnet has a resting state wherein only enough power is supplied to the electromagnet to keep the door in a locked state when subjected to only environmental stimuli such as a gust of wind. Then, should a more forceful attempt be made to open the door (i.e., an unauthorized attempt to enter), power to the electromagnet is increased to keep the door locked against the unauthorized attempt to open the door. The Eco-Mag design feature also requires a controlled amount of door movement in the door-opening direction, while the strike plate remains in contact with the energized electromagnet, in order for a door position sensor to sense when an unauthorized attempt to enter is being made.

In each of the three design features (Energy Absorbing, De-Mag or Eco-Mag), the electromagnetic door lock provides for a strike plate mounting bolt assembly whereby, while the strike plate remains in contact with an energized electromagnet, the door moves slightly away from the door frame when a force to open the door is applied to the door. In the prior art, the strike plate mounting bolt assembly includes a relatively large coil spring resiliently mounted in a through bore in the door to provide for relative movement between the door and strike plate. The prior art mounting bolt assembly required a large diameter hole to be bored through the door in order to receive the coil spring. Further, in the prior art, with the use of a coil spring as the resilient member, the dynamics of allowable door movement, that is, the door opening force and amount of door movement needed to compress the spring were not readily adjustable to accommodate the varied requirements of the above mentioned design features.

What is needed in the art is a strike plate mounting bolt assembly used in an electromagnetic door lock that provides for a more compact and robust electromagnetic door lock.

What is also needed in the art is a strike plate mounting bolt assembly used in an electromagnetic door lock that may be conveniently and selectively adjusted in the field to accommodate various needs of the associated electromagnetic door lock.

It is the principal object of the present invention to provide these and other needs.

SUMMARY OF THE INVENTION

Briefly described, the present invention is directed toward a strike plate mounting bolt assembly of an electromagnetic door lock wherein the strike plate mounting bolt assembly resiliently mounts the strike plate of the door lock to the associated door.

The strike plate mounting bolt assembly includes a bolt, a post and at least one Belleville washer. The bolt includes a shaft and a head wherein, when assembled to the door, the head abuts a rear face of the door. A through bore formed in the door is sized to receive an outer diameter of the shaft.

The post includes a head end and a shaft end wherein the head end is larger in diameter than the shaft end. Male threads formed in the shaft end are configured for engagement with female threads formed in the bolt at its shaft end. The strike plate includes a first bore and a second bore concentric with and larger in diameter than the first bore. The first bore is sized to receive the shaft end of the post.

The at least one Belleville washer has an outer diameter smaller than the diameter of the second bore so that the at least one Belleville washer can be received within the second bore. The at least one Belleville washer also includes a center hole larger than an outer diameter of the shaft end of the post so that the shaft end of the post can pass through the center hole.

In a further aspect of the invention, an assembly sequence to complete the assembly of the armature portion of the electromagnetic door lock is provided. First, the bolt is inserted into the door through bore. After inserting the shaft end of the post through the center hole of the at least one Belleville washer, the shaft end of the post is inserted through the first and second bores of the strike plate and the at least one Belleville washer is secured within a cavity in the strike plate. Male threads of the shaft end are then threaded into female threads formed in the bolt. The post is then tightened into the bolt.

In yet another aspect of the invention, the strike plate mounting bolt assembly may further include a post bushing having a through bore for receiving the shaft end and an outer diameter configured for being received by the second bore. When assembled, the post bushing is disposed between the underside of the head of the post and the at least one Belleville washer to provide a load bearing surface between the post and the at least one Belleville washer.

In a further aspect of the invention, a conical surface may be formed in the bushing to receive a similarly contoured conical surface formed in the underside of the head end of the post. In yet a further aspect of the invention, the mating surfaces between the post bushing and the underside of the head end of the post may be formed in a ball and socket arrangement.

In a further aspect of the invention, the selective stacking of two or more Belleville washers to form a Belleville washer pack may be used. By selecting the number of washers and the relative orientations of the selected washers in the pack, a force/deflection characteristic of the collection of Belleville washers can be varied to suit a variety of electromagnetic door lock features in the field.

In yet a further aspect of the invention, a method for tuning the force/deflection characteristics of a strike plate mounting bolt assembly to suit a particular electromagnet door lock may be include the steps of:

1. providing a collection of Belleville washers, each having a certain force/deflection characteristic;
2. determining the force/deflection characteristic needed for a particular feature design;
3. selecting a Belleville washer stack comprising one or more Belleville washers from the collection of Belleville washers in accordance with the determined force/deflection characteristics;
4. assembling the strike plate mounting bolt assembly using the selected stack to achieve the force/deflection characteristics needed.

Numerous applications, some of which are exemplarily described below, may be implemented using the present invention.

DETAILED DESCRIPTION OF THE PREFERRED EMBODIMENT

Figure 1:
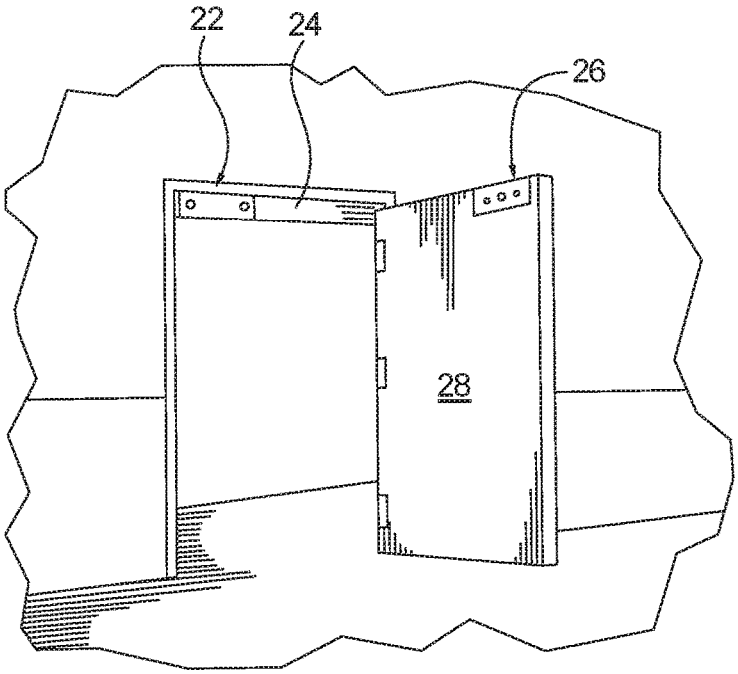
FIG. 1 shows a typical electromagnetic door lock installation.

FIG. 1 shows a typical electronic door lock installation. In a typical installation, an electromagnet 22 is secured to a door frame 24. A ferromagnetic armature or strike plate 26 is mounted on door 28. When door 28 is closed and electromagnet 22 is energized, electromagnet 22 exerts a magnetic force against strike plate 26 to hold door 28 in a closed and magnetically locked position.

Figure 2:
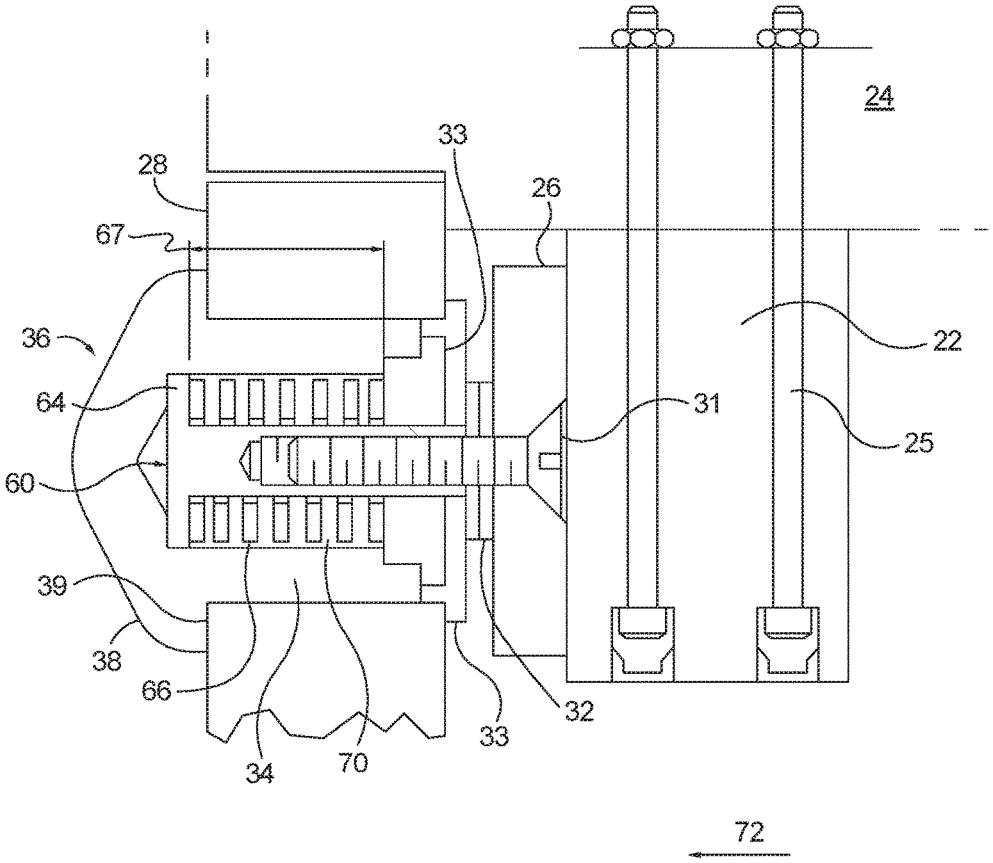
FIG. 2. PRIOR ART
FIG. 2 is a cross section view of a prior art electromagnetic door lock, including a prior art strike plate mounting bolt assembly.

FIG. 2 depicts the construction details of an electronic door lock of the prior art as disclosed in U.S. Pat. No. 5,758,913, wherein an amount of door movement in the opening direction is permitted while the armature of the lock remains in contact with an energized electromagnet. As shown, electromagnet 22 is mounted onto a door frame 24 via electromagnet mounting bolts 25 or other mounting means. Armature or strike plate 26 is mounted onto door 28 via strike plate mounting bolt assembly 30. One or more flexible washers 32 allow strike plate 26 to move to a degree so that strike plate 26 can abut electromagnet 22 in full contact for maximum hold force when door 28 is shut and electromagnet 22 is energized.

Figure 3:
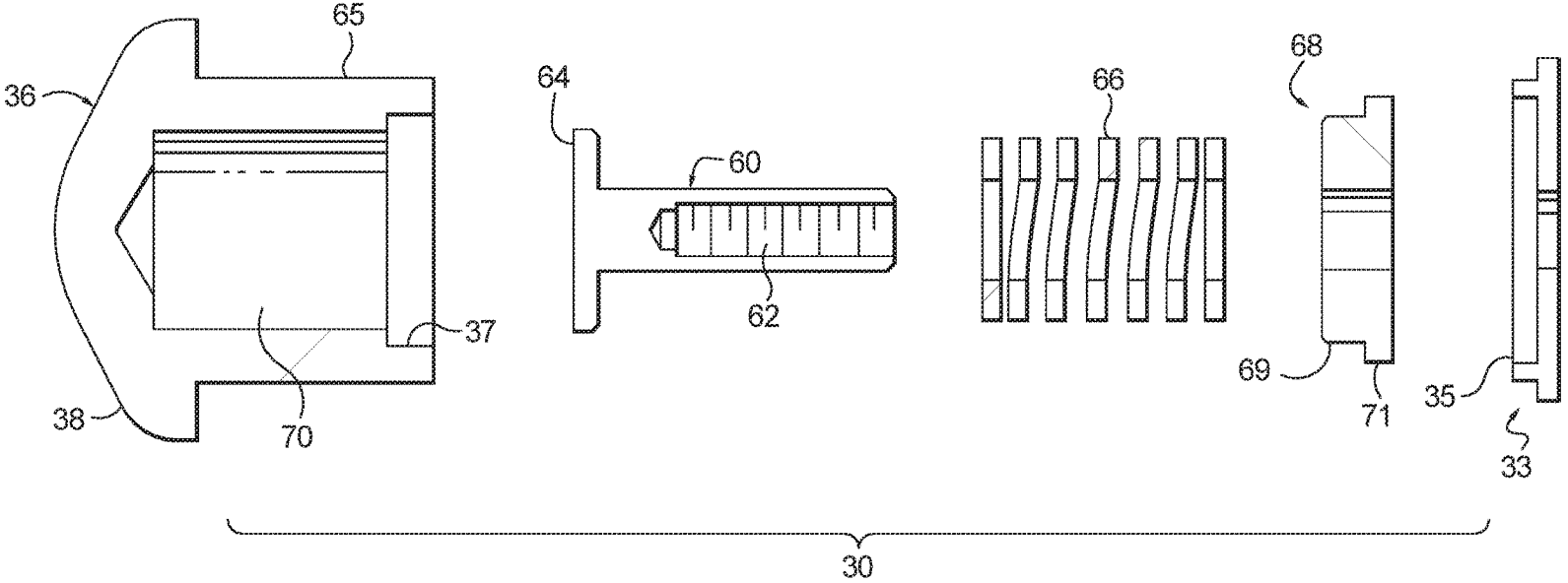
FIG. 3. PRIOR ART
FIG. 3 is an exploded, sectional view of the prior art strike plate mounting bolt assembly.

Referring now to both FIGS. 2 and 3, a strike plate mounting bolt assembly 30 includes a bolt housing 36, plunger 60, compression spring 66 and caps 33, 68. Bolt housing 36 includes a flange or head 38 which abuts the rear face 39 of door 28, and a shaft 34. Bolt housing 36 may be made tamper-resistant from its exposed end. Inside housing 36 is fitted plunger 60 having spring engagement or flanged portion 64 and having female threads 62. Spring 66 is also fitted inside housing 36. Plunger 60 and spring 66 are retained within cavity 70 of housing 36 by seal cap 68. Seal cap 68 is an annular member having inner threads 69 for engaging corresponding threads 37 on housing shaft 34, and having outer threads 71. The foregoing components are held in place within door 28 by post installation cap 33, having female threads 35 that engage corresponding outer threads 71 of seal cap 68. Male threads on attaching bolt 31 engage female threads 62 within plunger 60 to fasten plunger 60 to strike plate 26. Thus, plunger 60 serves to couple strike plate 26 to spring 66. Spring 66, as shown, may have a compression force approximately equal to or slightly less than the hold strength of electromagnet 20, when spring 66 is compressed a predetermined maximum allowable travel distance.

Thus, in the case of an electromagnetic door lock having the Energy Absorbing feature, while strike plate 26 is magnetically attracted to electromagnet 22 by energizing electromagnet 22, and when an impact force is applied to door 28 in direction 72 (FIG. 2), spring 66 is compressed within cavity 70, thereby absorbing some of the impact energy that would otherwise be imparted on the lock mechanism to separate strike plate 26 from an energized electromagnet 22. This allows for a lower power electromagnet to be used to effectively hold the door in a locked stated when an unauthorized attempt is made to open the door.

In the case of an electromagnetic door lock having the De-Mag feature, compression of spring 66 allows door 28 to move away from door frame 24 a distance approximately equal to the installed height 67 of spring 66, as shown in FIG. 2, minus the solid height of the spring when fully compressed. Movement of the door through this distance of approximately ¾ of an inch allows the delay function of the lock to operate.

Finally, in the case of an electromagnetic door lock having an Eco-Mag feature, the movement of the door through the distance of approximately ¾ of an inch allows a door position sensor, or the like, to sense that an unauthorized entry is being attempted and for the circuitry controlling the locking function to apply full power to electromagnet 22 in order to maintain the door in a locked state.

It is important to note that, in the prior art mechanism just described, the active height, and outer diameter of spring 66 must be selected to meet the force/deflection performance requirements of the particular design feature, whether the lock incorporates the Energy Absorbing, De-Mag or Eco-Mag features or any combination thereof. The resulting active spring height, solid height and outer diameter of the spring, whatever it is, must fit within the dimensions of bolt housing 36 since bolt housing 36 envelops the spring body. Accordingly, the size of cavity 70 must be large enough to receive the outer diameter of spring 66 (and the diameter of flange portion 64 of plunger 60), and the hole formed in the door must be large enough to receive the outer diameter 65 of the bolt housing, which may be as large as one inch in diameter.

Figure 4:
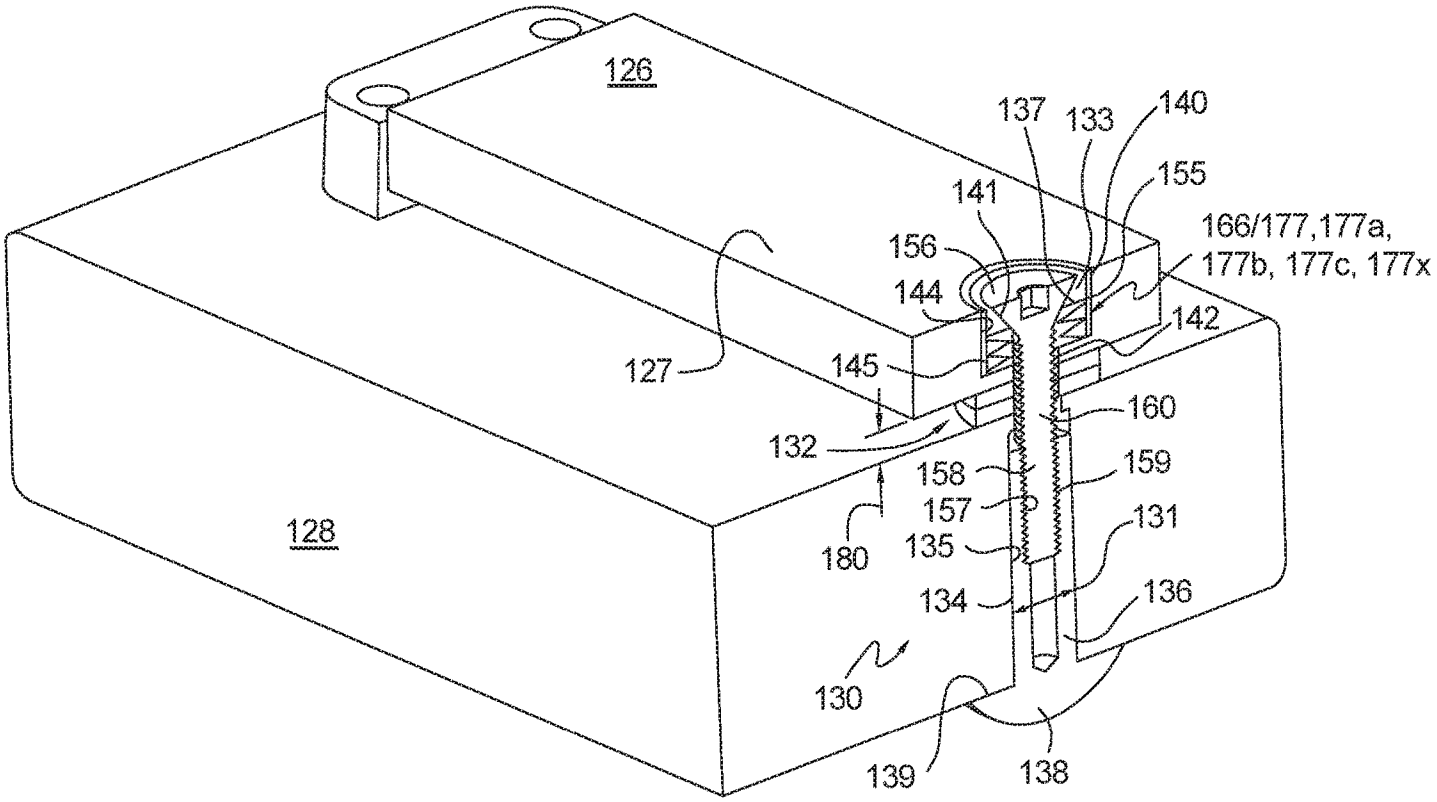
FIG. 4 is a sectional view of the strike plate portion of the electromagnetic door lock assembly in accordance with the invention, including the strike plate mounting bolt assembly wherein the door is in contact with the door frame.

Referring now to FIG. 4, in accordance with the invention, a cross-section taken through strike bolt mounting bolt assembly 130 is shown. A complementary electromagnet (shown generally as feature 22 in FIG. 1) is mounted to a door frame as known in the art. Strike plate 126 is movably mounted to door 128 via strike plate mounting bolt assembly 130. One or more flexible washers 132 may be optionally included to allow strike plate 126 to move, to a degree, so that strike plate 126 can abut the electromagnet in full contact for maximum hold force when door 128 is shut and the electromagnet is energized. Guide pins (not shown) in the strike plate that slideably mate with corresponding holes in the door keep the strike plate in proper alignment with the door through the strike plate's movement relative to the door.

Strike plate mounting bolt assembly 130 includes bolt 136, post 160 and at least one Belleville washer 166. Bolt 136 includes a flange or head 138 which abuts the rear face 139 of door 128, and a shaft 134. Through bore 135, formed in door 128, is sized to receive an outer diameter 131 of shaft 134. Head 138 of bolt 136 may be configured to be tamper-resistant from its exposed end.

Post 160 includes head end 156 and shaft end 158 wherein the head end is larger in diameter than the shaft end. Male threads 159 formed in shaft end 158 are configured for engagement with female threads 157 of bolt 136. Strike plate 126 includes first bore 142 and second bore 144 larger in diameter than first bore 142. First bore 142 is sized to loosely receive shaft end 158 of post 160. Second bore 144 forms a spring cavity for receiving the one or more Belleville washers 166.

Included in bolt assembly 130 is a resilient member such as at least one Belleville washer 166 having an outer diameter 170 smaller than a diameter of second bore 144 and a center hole 172 larger in diameter than an outer diameter of shaft end 158 of post 160.

To complete the assembly of the armature portion of an electromagnetic door lock assembly, bolt 136 is inserted into through bore 135. After inserting the shaft end 158 of post 160 through hole 172 of the at least one Belleville washer, preferably with convex side 174 (FIG. 6) of the Belleville washer facing head end 156 of post 160, shaft end 158 is inserted through first and second bores 142, 144 of strike plate 126. Male threads 159 of shaft end 158 are then threaded into female threads 157 of bolt 136. Post 160 is then tightened into bolt 136 until opposing surfaces of the at least one Belleville washer are in contact with second bore surface 145 and underside 155 of head end 156 of post 160 and, preferable, until post head end 156 is flush or below an outer surface 127 of the strike plate.

In one aspect of the invention, bolt assembly 130 may further include post bushing 133 having through bore 137 for receiving shaft end 158, and an outer diameter 140 configured for being received by second bore 144. When assembled, post bushing 133 is disposed between the underside of head 156 and the at least one Belleville washer to provide a load bearing surface between post 160 and the at least one Belleville washer. In a further aspect of the invention, a conical surface 141 may be formed in bushing 133 to receive a similarly contoured conical surface formed in the underside of head end 156. In yet a further aspect of the invention, the mating surfaces between post bushing 133 and the underside of the head end of bolt 136 may be formed in a ball and socket arrangement.

Figure 5:
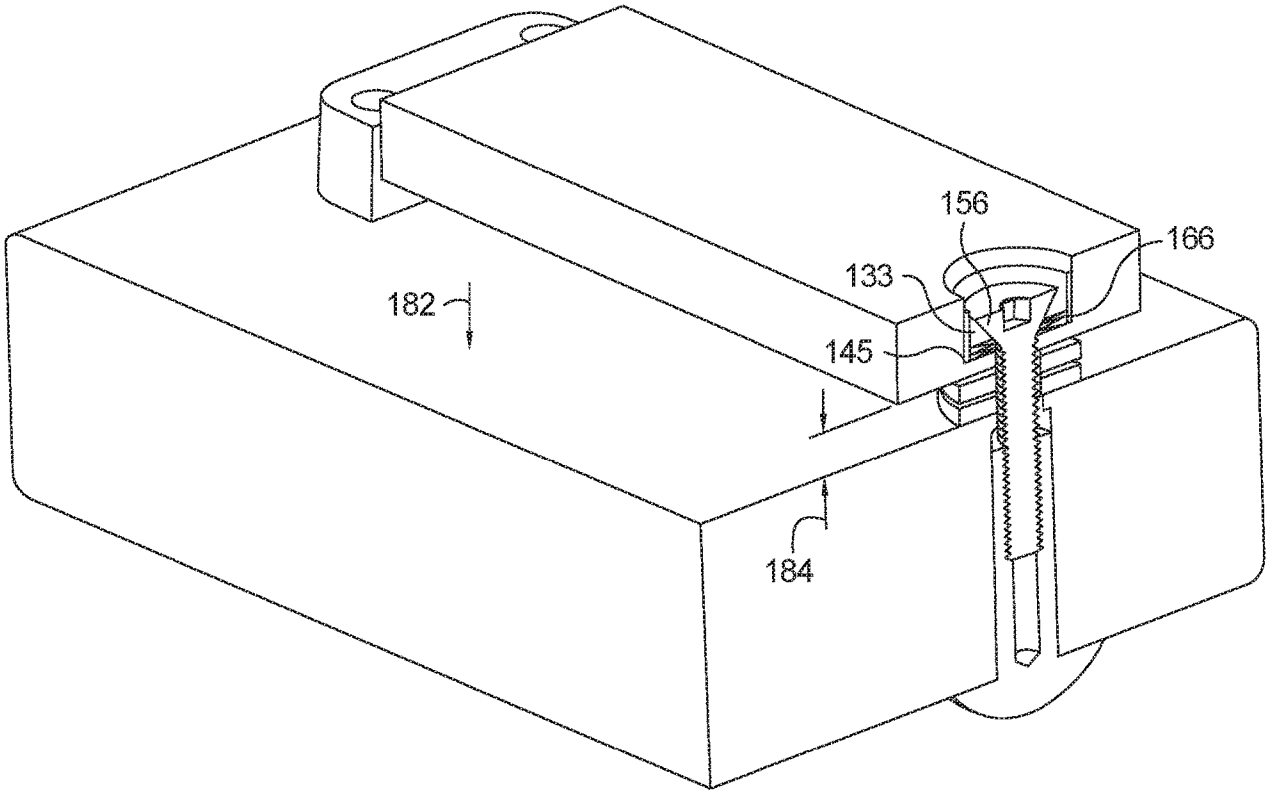
FIG. 5 is a sectional view of the strike portion shown in FIG. 4 wherein the Belleville washers are compressed.

As shown in FIG. 4, dimension 180 of the assembled strike plate mounting bolt assembly represents a first gap 180 between strike plate 126 and door 128 when door 128 is seated within a corresponding door frame. In FIG. 5, gap 184 represents a second gap between strike 126 and door 128 when an opening force is applied to the door in direction 182 while the strike remains engaged with the associated energized electromagnet. The difference between the two gaps (gap 184 minus gap 180) is associated with the amount of door movement ("initial door movement") provided by the strike plate mounting bolt assembly to accommodate the requirements of the Energy Absorbing, De-Mag or Eco-Mag design features. In one example in accordance with the invention, the initial door movement provided by strike plate mounting bolt assembly 130 was measured to be ⅛ inch, as compared to an initial door movement in accordance with the prior art of ¾ inch. From a pleasability standpoint, this reduction in initial door movement is a marked improvement. When in use, the reduced initial door movement gives a desirable perception or feel to the operator that the door remains secure.

Figure 6:
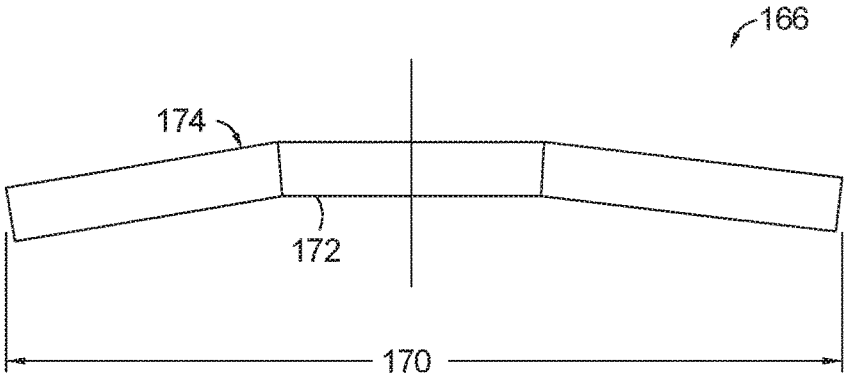
FIG. 6 is a diametrically sectioned view of a Belleville washer.

In a further aspect of the invention, the selective stacking of two or more Belleville washers (Belleville washer pack 177) may be utilized to tune the force/deflection characteristics needed for the particular application. A single Belleville washer exhibits certain load/deflection characteristics based upon its thickness, material, shape, etc. A Belleville washer is generally conical in cross-section (FIG. 6). When two washers are stacked so that their convex surfaces 174 are facing in the same direction, the force (load) doubles with no increase in deflection. When two washers are stacked so that their convex surfaces are facing in opposite directions (e.g., facing each other), deflection is doubled with no increase in force (load). Thus, by selecting the number of washers and the relative orientations of the selected washers, the force/deflection characteristic of the collection of Belleville washers can be varied to suit the application.

For example, assume a single Belleville washer requires an axial force of 500 pounds to be compressed 0.02 inches. Assume also that the particular feature design (Energy Absorbing, De-Mag or Eco-Mag) needs an axial force of 500 pounds to be developed by the Belleville washer through 0.04 inches of travel. A Belleville washer pack 117*a* consisting of two Belleville washers stacked so that concave surfaces 174 are facing in opposite directions may be selected to meet the design requirement. If the feature design requires an axial force of 1000 pounds to be developed through 0.02 inches of travel, a Belleville washer pack 117*b* consisting of two Belleville washers stacked so that concave surfaces 174 are facing in the same direction may be selected to meet the design requirement. In a final example of selective use of the washers, if the feature design requires an axial force of 1000 pounds to be developed through 0.12 inches of travel, a Belleville washer pack 117*c* consisting of four Belleville washers stacked in two pairs wherein each pair of washers are stacked so that the concave surfaces 174 are facing in opposite directions. From these examples, it can be seen that a Belleville washer stack 117*x* can be built to in a number of different combinations (washer thickness, number of washers and washer orientation) to provide flexibility of use of the strike plate mounting bolt assembly 130. Thus, a method of tuning the force/deflection characteristics of strike plate mounting bolt assembly may include the steps of:

1. providing a collection of Belleville washers, each having a certain force/deflection characteristic;
2. determining the force/deflection characteristic needed for a particular feature design;
3. selecting a Belleville washer stack comprising one or more Belleville washers from the collection of Belleville washers in accordance with the determined force/deflection characteristics;
4. assembling the strike plate mounting bolt assembly using the selected stack to achieve the force/deflection characteristics needed.

The strike plate mounting bolt assembly 130, in accordance with the invention, provides a more compact and robust electromagnetic door locks that may be conveniently and selectively adjusted in the field to accommodate various needs of the associated electromagnetic door lock Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

The invention claimed is:

1. An electromagnetic lock having a strike plate that is resiliently mountable to a door, said lock comprising:

a. an energizable electromagnet mountable to a door frame;

b. said strike plate includes a first through bore and an outer surface facing said energizable electromagnet, wherein said strike plate includes a cavity concentric with said first through bore; and c. a strike plate mounting bolt assembly for resiliently mounting said strike plate to said door, said strike plate mounting bolt assembly comprising:

i. a bolt configured to be received in a second through bore in said door;

ii. a post connected to said bolt, wherein said post includes a head end and a shaft end, wherein said head end is oriented proximate said outer surface of said strike plate when said strike plate is mounted to said door; and iii. a resilient member received between said head end of said post and said strike plate proximate the outer surface of said strike plate, wherein said resilient member is received in said cavity.

2. The electromagnetic lock of claim 1 wherein said resilient member is at least one Belleville washer.

3. A strike plate mounting bolt assembly of for resiliently mounting a strike plate to a door, wherein said strike plate includes a second through bore, wherein said strike plate includes a cavity concentric with said second through bore and disposed on an outer surface of said strike plate, wherein an energizable electromagnet is configured to exert a magnetic force against said strike plate when energized, the strike plate mounting bolt assembly comprising:

a. a bolt configured to be received in a first through bore in said door;

b. a post connected to said bolt, wherein said post includes a head end, and wherein said head end is oriented proximate said outer surface of said strike plate facing said energizable electromagnet when said strike plate is mounted to said door; and c. a resilient member received between said head end of said post and said strike plate proximate the outer surface of said strike plate, wherein said resilient member is receivable in said cavity.

4. The strike plate mounting bolt assembly of claim 3 wherein said resilient member is at least one Belleville washer.

5. The strike plate mounting bolt assembly of claim 3 wherein said resilient member is at least one Belleville washer.

6. The electromagnetic lock of claim 1 wherein said bolt includes a head, and wherein said head is configured to abut a rear face of said door.

7. The electromagnetic lock of claim 1 wherein said bolt includes a shaft, and wherein said shaft end of said post is configured to be threadably received by said shaft of said bolt.

8. An electromagnetic lock having a strike plate that is resiliently mountable to a door, said lock comprising:

a. an energizable electromagnet mountable to a door frame;

b. said strike plate includes a first through bore and a cavity, wherein said cavity is concentric with said first through bore; and c. a strike plate mounting bolt assembly for resiliently mounting said strike plate to said door comprising:

i. a bolt having a head and a shaft, wherein the head is configured to abut a rear face of said door, and wherein said shaft is configured to be received in a second through bore in said door;

ii. a post having a head end and a shaft end, wherein said shaft end is configured to be threadably received by said shaft of said bolt; and iii at least one Belleville washer received by said shaft end of said post and received between said strike plate and said head end of said post in said cavity.

9. A strike plate mounting bolt assembly for resiliently mounting a strike plate to a door, wherein the strike plate includes a first through bore and a cavity, and wherein the cavity is concentric with the first through bore, the strike plate mounting bolt assembly comprising:

a. a bolt having a head and a shaft, wherein said shaft is configured to be received in a second through bore in said door;

b. a post having a head end and a shaft end, wherein said shaft end is configured to be threadably received by said shaft of said bolt; and c. at least one Belleville washer received by said shaft end of said post and receivable between said strike plate and said head end of said post in the cavity.

* * * * *